US008653914B2

(12) United States Patent
Jones

(10) Patent No.: US 8,653,914 B2
(45) Date of Patent: Feb. 18, 2014

(54) SAFETY SWITCH

(75) Inventor: Derek W. Jones, Galloway (GB)

(73) Assignee: Rockwell Automation Limited, Maldon, Essex (GB)

( * ) Notice: Subject to any disclaimer, the term of this patent is extended or adjusted under 35 U.S.C. 154(b) by 69 days.

(21) Appl. No.: 13/113,221

(22) Filed: May 23, 2011

(65) Prior Publication Data

US 2011/0291776 A1 Dec. 1, 2011

(30) Foreign Application Priority Data

May 26, 2010 (EP) ..... 10250982

(51) Int. Cl.
*H01H 3/00* (2006.01)

(52) U.S. Cl.
USPC ..... 335/185; 335/202

(58) Field of Classification Search
USPC ..... 335/185, 202
See application file for complete search history.

(56) References Cited

U.S. PATENT DOCUMENTS

| | | | | |
|---|---|---|---|---|
| 5,541,562 | A | 7/1996 | Fletcher et al. | |
| 7,504,918 | B2 * | 3/2009 | Prendergast et al. | 335/205 |
| 2008/0023307 | A1 * | 1/2008 | Kerr | 200/43.04 |

FOREIGN PATENT DOCUMENTS

| | | | |
|---|---|---|---|
| DE | 10 2004 038 488 | A1 | 2/2006 |
| EP | 0837485 | A2 | 4/1998 |
| EP | 0987726 | A2 | 3/2000 |

OTHER PUBLICATIONS

European Search Report dated Oct. 20, 2010 (European Patent Application No. 10 25 0982).

* cited by examiner

*Primary Examiner* — Elvin G Enad
*Assistant Examiner* — Lisa Homza
(74) *Attorney, Agent, or Firm* — William R. Walbrun; Boyle Fredrickson, S.C.; John M. Miller

(57) ABSTRACT

A safety switch assembly having a number of fixed and movable contacts, a control mechanism that alters the conducting state of the contacts, and a magnetisable member that extends between alternate portions of the safety switch assembly. The safety switch assembly includes a magnetically operable electrical switch that is located in a body of the switch assembly and positioned proximate the magnetisable material such that changes in the magnetic condition of the magnetisable material alter the conducting state of the magnetically operable electrical switch.

13 Claims, 5 Drawing Sheets

SAFETY SWITCH

CROSS REFERENCE TO RELATED APPLICATIONS

This application claims priority to European Patent Application No. 10250982.5 filed on May 26, 2010 titled "Safety Switch" and the disclosure of which is incorporated herein.

BACKGROUND

The present invention relates to a safety switch.

Safety switches are well known, and are typically used to prevent access to for example electromechanical machinery when that machinery is in operation. In a conventional arrangement the safety switch is mounted on a doorpost of a machinery guard, and an actuator for the safety switch is mounted on a corresponding door. When the door is closed the actuator engages with the safety switch, which in turn closes a set of electrical contacts which allow power to be supplied to the machinery. This arrangement ensures that power can only be supplied to the machinery when the guard door is shut. When the guard door is opened, the actuator disengages from (i.e. is withdrawn from) the safety switch, thereby opening the electrical contacts and cutting off the supply of power to the machinery.

A typical safety switch comprises a body, in which is provided a set of contacts fixed in position relative to the body. An axially slideable plunger is mounted inside the body, and is moveable relative to the body. The plunger (or another plunger in contact with the plunger, for example a contact block plunger) is provided with another set of contacts. The plunger is biased towards a cam arrangement or other control arrangement by a biasing element, such as a spring. The actuator mentioned above is arranged to engage with the cam arrangement. DE102004038488 discloses an example of a safety switch having a contact block plunger that is movable in response to engagement or withdrawal of an actuator to effectuate the making or breaking of the electrical connection of the safety switch.

In many safety switches, if the actuator is not engaged with the cam arrangement (e.g. if the actuator is not engaged with the safety switch), the cam arrangement is arranged to prevent the contacts on the plunger coming into contact with the contacts in the body of the switch by preventing movement of the plunger (i.e. the plunger is kept in a first plunger position). By preventing the contacts from contacting one another, the switch cannot conduct electricity while the actuator is not engaged with the cam arrangement.

Bringing the actuator into engagement with the cam arrangement causes the cam arrangement to rotate, which in turn causes the plunger (which is biased toward the cam arrangement) to move into a notch provided in the cam arrangement. The plunger is then in a second plunger position. When the plunger moves into the notch, the contacts on the plunger are brought into contact with the contacts of the body of the switch, allowing electricity to flow through the safety switch.

In many safety switches, the plunger is provided with two independent bridge contacts, which are moveable (e.g. with movement of the plunger) to each bridge to fixed contacts provided in the body of the safety switch. The use of two bridge contacts and corresponding fixed contacts provides some redundancy and/or added safety functionality. A safety switch, or a configuration of which the safety switch is a part, is frequently configured so that both bridge contacts of the plunger need to be brought into electrical connection with their respective fixed contacts in the body of the safety for the safety switch as a whole to conduct electricity (or, more generally, for the arrangement of which the safety switch is a part to, as a whole, conduct electricity). If damage to the safety switch results in one of the bridge contacts becoming deformed or damaged or the like, or simply not moveable into connection with the respective fixed contacts, the safety switch as a whole, or an arrangement of which the safety switch forms a part, cannot conduct electricity.

The use of two bridge contacts and corresponding fixed contacts improves the safety and functionality of a safety switch. However, the safety and functionality could be further improved. For instance, one or more parts of the safety switch may become damaged or destroyed, and the damage or destruction may result in the bridge contacts of the contact block plunger being brought into and/or kept in contact with the fixed contacts of the body of the safety switch. Thus, even though the safety switch is damaged, the safety switch, or a configuration of which the switch forms a part, may still be in a conductive state. This may be the case even if an actuator is not engaged with the safety switch. In theory at least, this means that a user could enter a machinery guard while the machinery inside is still powered and/or operating, defeating the purpose of the safety switch. It is desirable to avoid this situation.

One solution to the above-mentioned problem is to provide more than one safety switch. If one switch is damaged, the other might still be operational. However, this can lead to cost implications, such as the need to purchase an additional safety switch, and to install and maintain this additional safety switch. Furthermore, in some situations it may be difficult to install a further safety switch due to spatial limitations or the like.

It is therefore an object of the present invention to provide an improved or alternative safety switch or safety switch assembly which may overcome or substantially mitigate at least one disadvantage of the prior art, whether identified herein or elsewhere.

SUMMARY OF THE INVENTION

According to a first aspect of the present invention there is provided a safety switch having a body supporting a contact block provided with at least two fixed contacts, a contact block plunger provided with a bridge contact, the contact block plunger being moveable to move the bridge contact into and out of electrical connection with the two fixed contacts; a biasing element arranged to bias the contact block plunger towards a control mechanism of the safety switch. The safety switch further comprises a head having at least a part of the control mechanism, engageable with an actuator, and moveable to control movement of the contact block plunger upon engagement or withdrawal of the actuator. The control mechanism being moveable from a first configuration, where the actuator is withdrawn and the contact block plunger is in a position that keeps the fixed contacts and bridge contacts out of electrical connection with one another, to a second configuration, where the actuator is engaged and the contact block plunger is in a position that brings the bridge contact into electrical connection with, and bridges, the two fixed contacts. The safety switch includes a magnetically operable switch located in the body and a magnetisable material that extends from a part of the safety switch proximate to a location of engagement of the actuator, to a region proximate to the magnetically operated switch.

The safety switch is suitable for affecting the operating state of equipment to which the safety switch is at least indirectly connected (e.g. via a controller or the like).

The magnetisable material may extend from outside of the body, and into the body.

The magnetisable material may extend from the head and into the body.

The magnetisable material may extend from a location adjacent to or at an external surface of the head, and into the body.

The magnetisable material may have a substantially rod-like shape, which might be easier to manufacture or install than other shapes.

The body may be sealable or may be sealed.

The body may be sealable or may be sealed to prevent at least one of water or dirt from entering into the body.

The head may be unsealable, or may be unsealed.

The head may be unsealable, or may be unsealed, such that at least one of water or dirt is allowed to come into contact with the at least a part of the control mechanism that is engageable with said actuator.

The magnetically operable switch may be in an open state (e.g. by default), unless the magnetisable material is magnetised.

The magnetically operable switch may be or comprise a reed switch.

The control mechanism may comprise a rotatable cam arrangement, the cam arrangement being the part of the control mechanism located in the head.

The control mechanism may comprise a switch plunger located in between the cam arrangement and the contact block plunger.

The switch plunger may extend between the head and the body (e.g. through one or more apertures, which may be sealed).

According to a second aspect of the present invention there is provided a safety switch assembly and an actuator for engagement with at least a part of a control mechanism of the safety switch. The actuator comprises a magnet, the magnet being located such that when the actuator is engaged with at least a part of the control mechanism of the safety switch, the magnet is proximate to a magnetisable material to assess interaction of the actuator with the safety switch and/or altering a conduction state of the circuit associated with the safety switch.

The magnet may be one or more of, or a combination of: attached to the actuator; and/or a part of the actuator.

BRIEF DESCRIPTION OF THE DRAWINGS

Embodiments of the present invention will now be described, by way of example only, with reference to the accompanying drawings, in which.

DETAILED DESCRIPTION OF THE PREFERRED EMBODIMENTS

Figure 1:
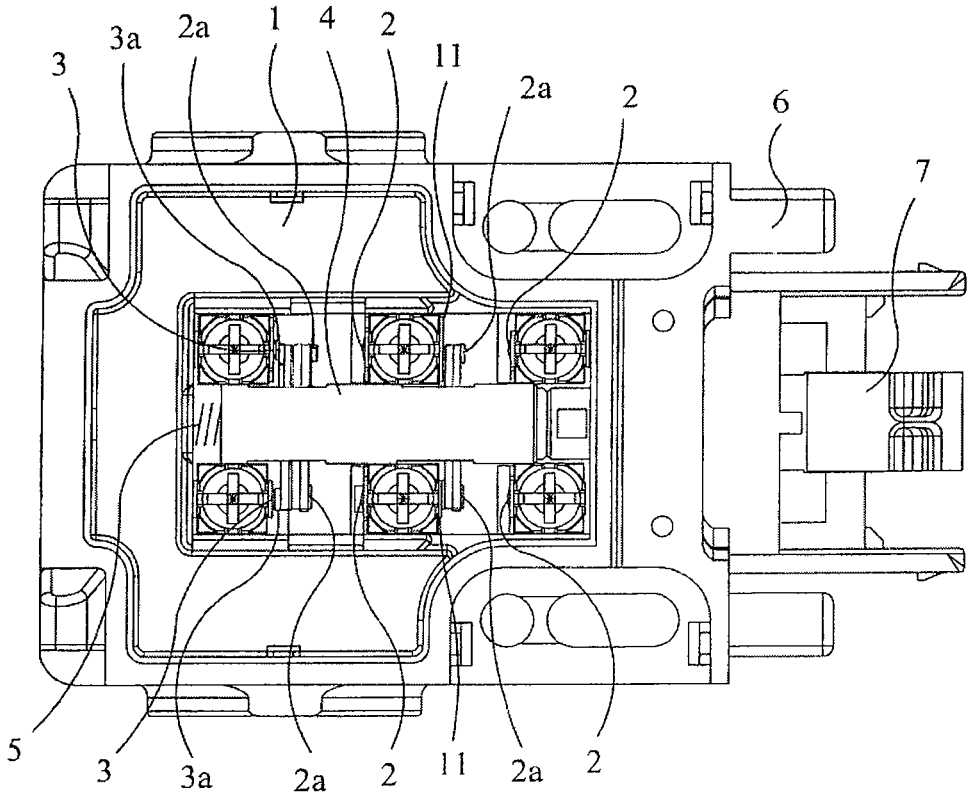
FIG. 1 schematically depicts a safety switch in accordance with an embodiment of the present invention.

FIG. 1 depicts a plan view of a safety switch in accordance with an embodiment of the present invention. The safety switch comprises two main parts. One part of the safety switch comprises a main body 1 of the safety switch. Mounted within the body 1 are electrical contacts which are fixed in position relative to the body 1. These fixed contacts may be described as a contact block. The contact block may be removable from the body 1.

In this embodiment, the contacts consist of two pairs (i.e. two sets of two) safety contacts 2 and a fixed pair of auxiliary contacts 3. Also mounted within the body 1 is a contact block plunger 4 which is slideable relative to the body 1 in an axial direction. In this embodiment, the contact block plunger 4 is provided with bridge contacts 2*a*, 3*a*, which extend through the contact block plunger 4 and which in this embodiment are moveable relative to the contact block plunger 4 (e.g. to allow for greater tolerance in the movement of the contact block plunger 4). The moveable contacts 2*a*, 3*a* comprise two independently moveable safety bridge contacts 2*a* and an auxiliary bridge contact 3*a*. By moving the contact block plunger 4, the moveable contacts 2*a*, 3*a* can be brought into contact (and thus electrical connection) with the fixed contacts 2, 3 of the safety switch. The contact block plunger 4 is also provided with a moveable insulating barrier 11 which serves to provide additional electrical insulation for some of the moveable safety contacts 2*a*.

The contact block plunger 4 is biased by a spring 5 (or other suitable biasing element) towards a second part of the safety switch, which is a head 6 of the safety switch. The head 6 of the safety switch may be detachable from and/or rotatable relative to the body 1. In another example (not shown) the head 6 and body 1 may be integrally formed. In this example, the body 1 is larger in size than the head 6. However, in other examples, the body 1 may be smaller in size than the head 6. The terms 'head' and 'body' may be used to distinguish between different parts, sections, volumes, regions, or the like, of the safety switch.

The head 6 of the safety switch is provided with a rotatable cam arrangement 7. The cam arrangement 7 is arranged to receive and engage with an actuator (not shown in FIG. 1). Engagement or disengagement of the actuator with the cam arrangement 7 causes the cam arrangement 7 to rotate, which in turn causes axial movement of the contact block plunger 4 within the body 1 of the safety switch.

Usually, the head of the safety switch is not sealed or is not sealable. Water or dirt or the like may, for example, enter the head of the safety switch (e.g. via apertures for insertion of an actuator) and come into contact with the cam arrangement. Usually, the body is sealed or is sealable. Water or dirt or the like may not, for example, enter the body of the safety switch. This may be advantageous, for example to protect the electrically conductive parts of the contact block and prevent damage to the contact block and/or the safety switch as a whole.

Figure 2:
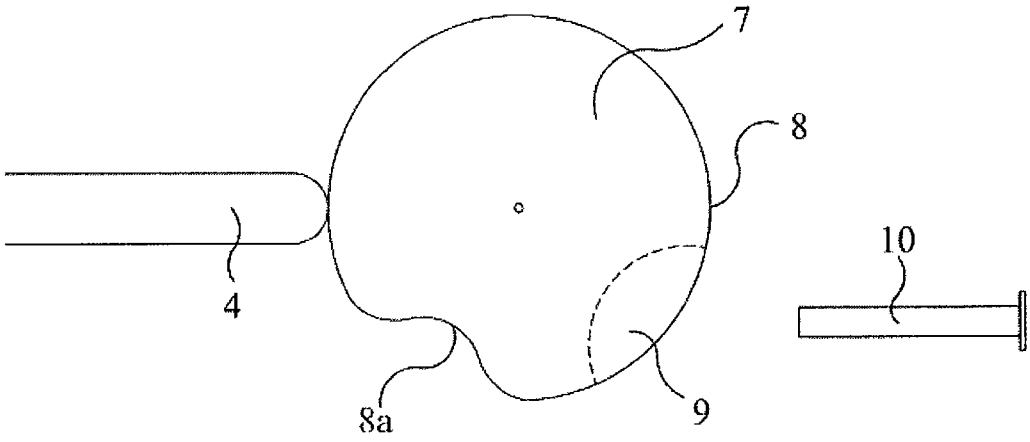
FIGS. 2 and 3 schematically depict a cam arrangement of the safety switch of FIG. 1.
Figure 3:
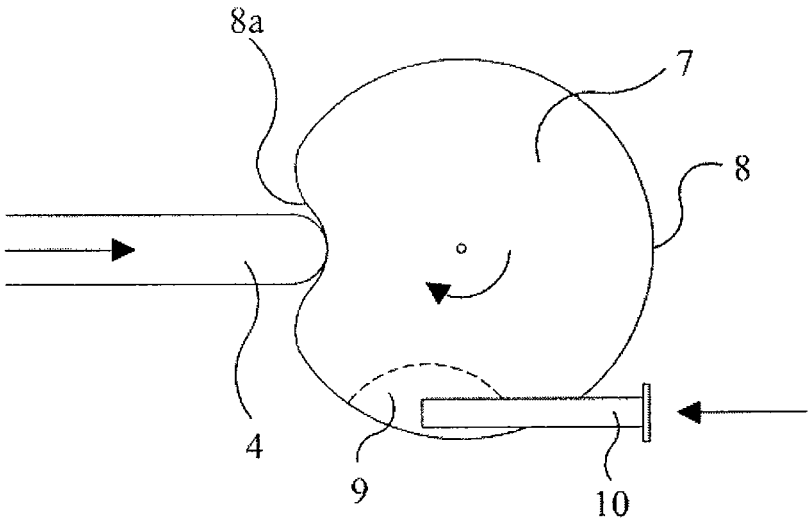

FIGS. 2 and 3 illustrate an interaction between the cam arrangement 7 and the contact block plunger 4. FIG. 2 shows that the cam arrangement 7 defines a cam surface 8. The cam surface 8 is provided with or forms an indentation 8*a* which is (upon rotation of the cam arrangement 7) arranged to receive the contact block plunger 4. The cam arrangement 7 is also provided with a notch 9 for receiving and engaging with an actuator 10. It can be seen from FIG. 2 that when no actuator is brought into engagement with the cam arrangement 7, the cam arrangement pushes back against the contact block plunger 4 (which is biased toward the cam arrangement 7 by a spring) and prevents the contact block plunger 4 from moving any further towards the centre of the cam arrangement 7. The contact block plunger 4 is said to be in a first contact block plunger position.

It can be seen from FIG. 1 (in combination with FIG. 2) that when no actuator is brought into engagement with the cam arrangement 7, all of the fixed safety contacts 2 of the body 1 of the safety switch are kept apart from all of the moveable safety bridge contacts 2*a* of the contact block plunger 4. Thus, when no actuator is engaged with the cam arrangement 7, the safety contacts 2, 2*a* are not in electrical connection with each other, which prevents the safety switch from conducting electricity (to, for example, electrically powered machinery within a machine guard). In this embodiment, when no actuator is engaged, the auxiliary contacts 3, 3*a* are in contact with each other, which may allow an auxiliary power supply to be supplied to the switch (for example, to power a light which indicates that no actuator has been engaged with the switch).

FIG. 3 depicts an actuator 10 that has been brought into engagement with the cam arrangement 7. It can be seen from FIG. 3 that when the actuator 10 has been brought into engagement with the cam arrangement 7, the cam arrangement 7 and therefore cam surface 8 are arranged to rotate in a clockwise direction. Rotation of the cam arrangement 7 causes the indentation 8*a* in the cam surface 8 to be brought into alignment with an end of the contact block plunger 4. As the indentation 8*a* moves into alignment with the end of the contact block plunger 4 (which is biased by a spring) the contact block plunger 4 moves towards the right of FIG. 3. The contact block plunger 4 is said to be in a second contact block plunger position.

Figure 4:
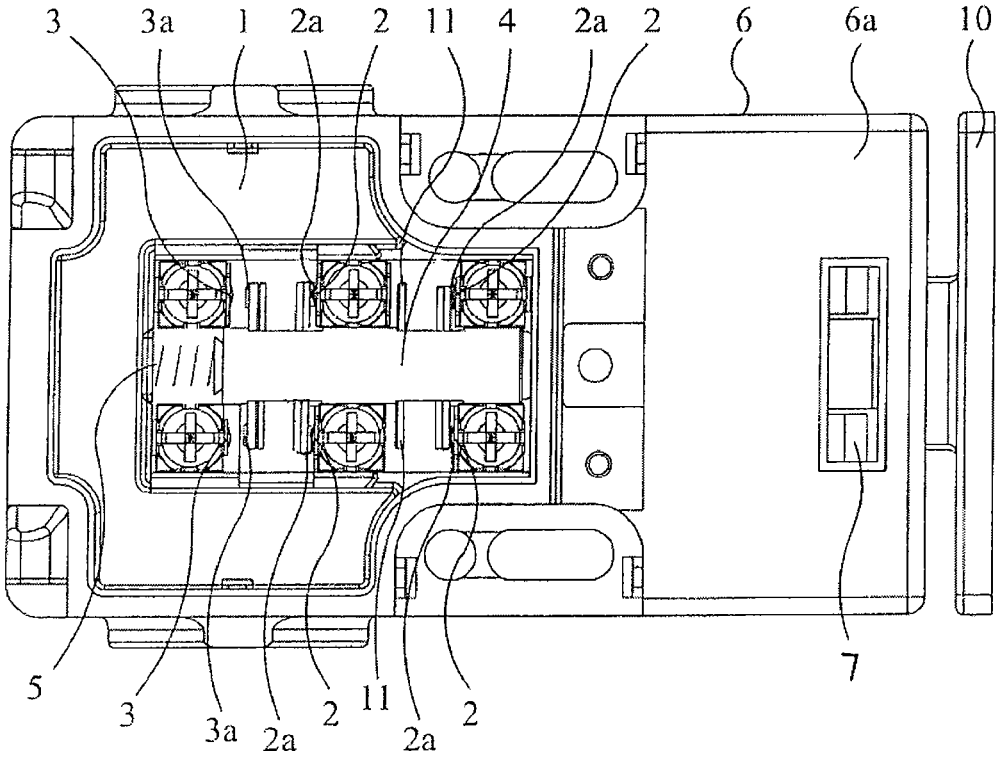
FIG. 4 schematically depicts operating principles of the safety switch of FIG. 1.

FIG. 4 shows the safety switch of FIG. 1, but now with an end cap 6*a* enclosing the head 6 of the safety switch. The end cap 6*a* protects the cam arrangement 7 from dirt, debris, and damage, and may make the safety switch more aesthetically pleasing. FIG. 4 shows the safety switch when an actuator 10 has been engaged with the switch.

It can be seen from FIG. 4 that when the actuator 10 is brought into engagement with the cam arrangement 7, the contact block plunger 4 moves towards the right of FIG. 4. When the contact block plunger 4 moves to the right, all of the moveable safety bridge contacts 2*a* are brought into electrical connection with the fixed safety contacts 2 of the body 1 of the safety switch. When all of the safety contacts 2, 2*a* are brought into electrical connection with each other, the switch is capable of conducting electricity (to, for example, electrically powered machinery within a machine guard).

The safety switch is configured, or is part of an arrangement that is configured such that if one or more of the safety contacts 2, 2*a* are not in electrical connection with each other, the switch is incapable of conducting electricity. The use of multiple safety contacts therefore offers some redundancy, and/or improves the safety functionality provided by the safety switch. However, it is possible that in some circumstances the safety contacts 2, 2*a* may be brought into engagement with one another, allowing the safety switch (or a configuration of which the switch forms a part) to conduct electricity, even when the actuator is not engaged with the safety switch. Such circumstances may arise due to damage to one or more components of the safety switch. This problem can be obviated or mitigated by the provision of a second safety switch used in parallel with the first safety switch. However, the use of two safety switches will add to the overall purchase cost, installation cost, and maintenance cost. It is therefore desirable to be able to improve the redundancy and/or safety functionality of a single safety switch, thereby avoiding the need to use a second safety switch.

According to an embodiment of the present invention, the problems mentioned above may be obviated or mitigated by the provision of components in a safety switch which allow the presence and/or absence (and preferably engagement and/or disengagement) of an actuator to be detected. If a bridge contact is brought into connection with fixed contacts of the body of the safety switch, this indicates that the contact block plunger has been moved in an appropriate manner to achieve such contact. However, this approach alone does not take into account the fact that the plunger may have been moved due to damage or the like to the safety switch. By detecting the presence and preferably the engagement of the actuator, further certainty is obtained as to the integrity of the safety switch and its operation.

According to an embodiment of the present invention, there is thus provided a safety switch. The safety switch comprises a body. In that body is located a contact block provided with at least two fixed contacts. A contact block plunger is also provided, and that contact block plunger is provided with a bridge contact. The contact block plunger is moveable (e.g. in an axial manner) to move the bridge contact into and out of electrical connection with (i.e. to bridge) the two fixed contacts. The body further comprises a biasing element, which is arranged to bias the contact block plunger towards a control mechanism of the safety switch (e.g. comprising a cam arrangement or the like). The safety switch further comprises a head. The head may be in connection with, or connectable to, or integral to the body. The head comprises at least a part of the control mechanism mentioned previously, for example a cam arrangement. The part of the control mechanism contained within the head is engageable with an actuator, and is movable (e.g. rotatable or slideable) to control movement of the contact block plunger upon engagement or withdrawal of the actuator. The control mechanism (or the part thereof) is movable from a first configuration, where the actuator is withdrawn and the contact block plunger is in a position that keeps the fixed contacts and bridge contacts out of electrical connection with one another (in normal operation), to a second configuration, where the actuator is engaged and the contact block plunger is in a position that brings the bridge contact into electrical connection with the two fixed contacts (again, in normal operation).

The safety switch assembly or safety switch system according to the present invention includes at least one additional component with respect to the heretofore description. At least one of main body 1 and/or head 6 of the safety switch assembly includes a magnetically operable switch (capable of conducting electricity) that is preferably located in the body 1 of the safety switch. The safety switch also includes a magnetisable material that extends from a part of the safety switch proximate to a location of engagement of the actuator, to a region proximate to the magnetically operated switch.

In use, the safety switch will form part of a safety switch assembly which additionally comprises an actuator for engagement with at least a part of the control mechanism of the safety switch. In accordance with another and/or related embodiment of the present invention, the actuator will comprise a magnet, the magnet being located such that when the actuator is engaged with at least a part of the control mechanism of the safety switch, the magnet is proximate to the magnetisable material. This means that when the actuator is engaged with the safety switch, the magnet is able to magnetise the magnetisable material, and this magnetisation is able to change the state of the magnetically operated switch within the body of the safety switch. Thus, not only will the safety switch be able to detect whether the bridge contact of the plunger has been brought into fixed contacts of the body, but the safety switch will also be able to determine whether the actuator has been engaged with the safety switch, thereby providing additional redundancy and/or safety functionality.

Embodiments of the present invention, and operating principles thereof, will now be described, by way of example only, with reference to FIGS. 5 to 8. Features appearing in those Figures which have already been shown in and described with reference to previous Figures are given the same reference numerals for clarity and consistency. The Figures are not drawn to any particular scale, unless explicitly stated otherwise.

Figure 5:
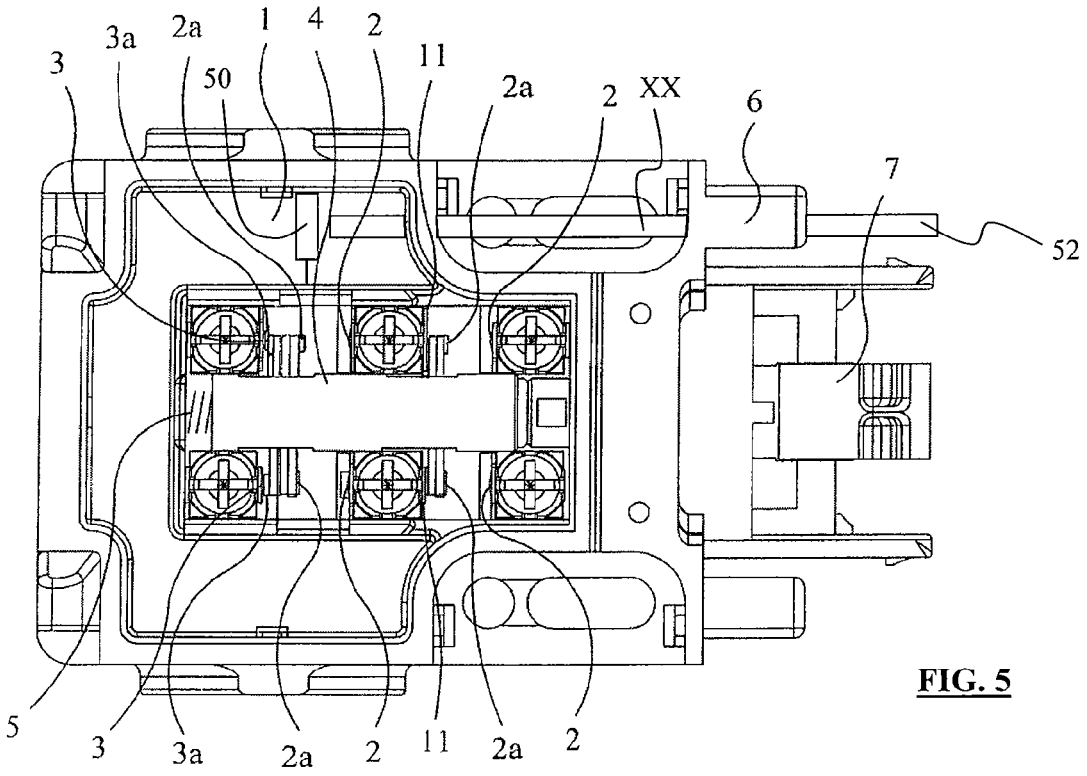
FIG. 5 schematically depicts a safety switch in accordance with an embodiment of the present invention, in a first configuration.

FIG. 5 schematically depicts a safety switch having all the features as shown in and described with reference to FIG. 1. In addition to those features already described, the safety switch according to an embodiment of the present invention as shown in FIG. 5 comprises a magnetically operable switch 50 (capable of conducting electricity) located within the body 1 of the safety switch. Magnetisable material 52 has a substantially rod-like shape and extends from a location adjacent to, or at an external surface of, the head 6 of the safety switch, into the body 1 of the safety switch, and into proximity with the magnetically operable switch 50. The location adjacent to, or at an external surface of, the head 6 of the safety switch is proximate to a location of engagement of an actuator, engageable with the cam arrangement 7 of the safety switch.

Figure 6:
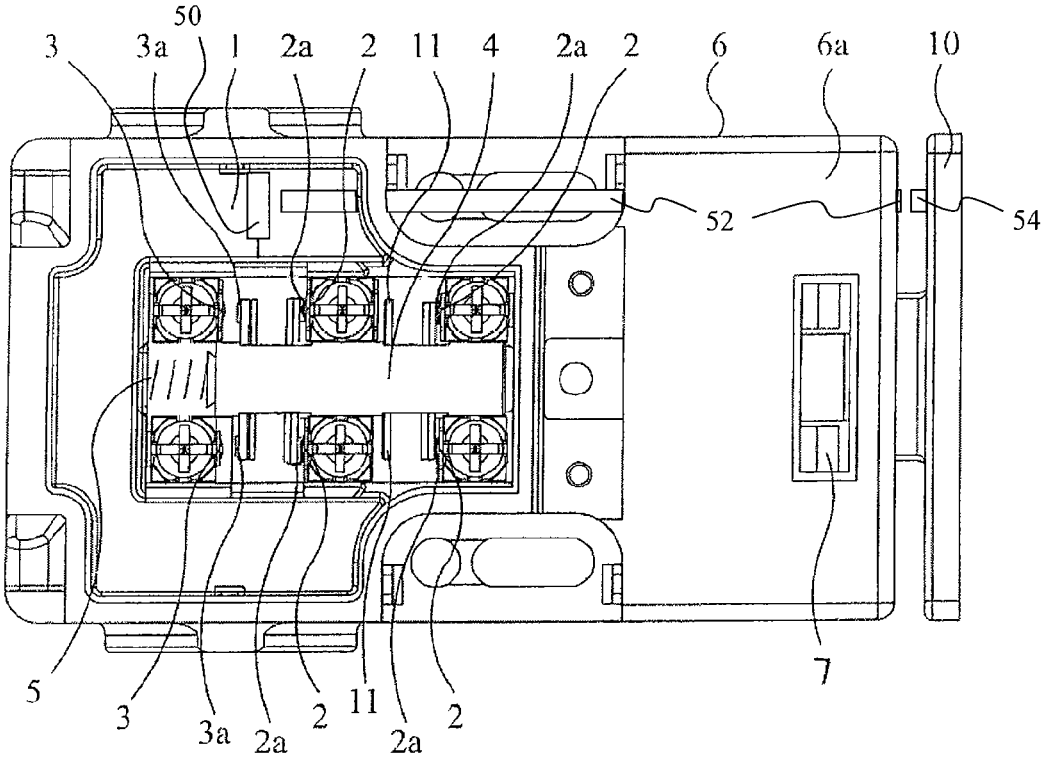
FIG. 6 schematically depicts the safety switch according to the embodiment of the present invention as shown in FIG. 5, but in a second, different configuration.

FIG. 6 shows the safety switch when an actuator 10 has been brought into engagement with the safety switch, and in particular the cam arrangement 7 of the safety switch. Actuator 10 includes a magnet 54. The magnet is located such that when the actuator 10 is engaged with the safety switch and in particular the cam arrangement 7 thereof, the magnet 54 is proximate to the magnetisable material 52. In other embodiments, the magnet 54 may come into contact with the magnetisable material 52.

When the magnet 54 is brought into proximity with or contact with the magnetisable material 52, the magnetisable material 52 becomes magnetised. Magnetisation of the magnetisable material 52 establishes a magnetic field, which in turn affects the operating state of the magnetically operable switch 50 located in the body 1 of the safety switch. Thus, in accordance with an embodiment of the present invention, the presence and/or absence of the actuator 10 can be detected in the sealed or sealable environment of the body 1 of the safety switch (i.e. as opposed to the head of the safety switch, which may not be sealed).

Figure 7:
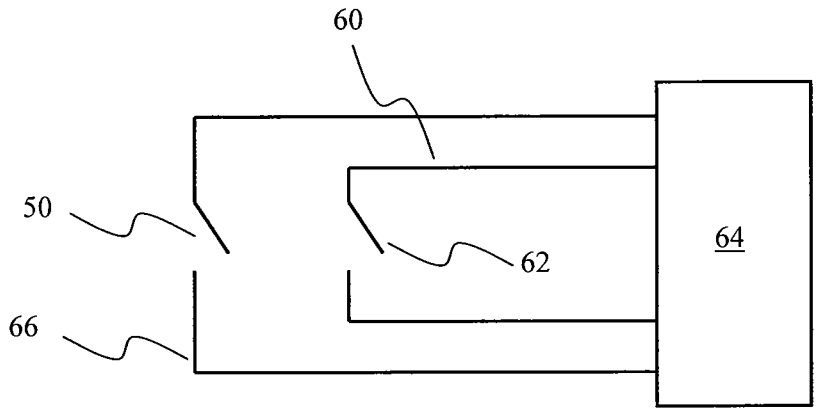
FIGS. 7 and 8 schematically depict circuit diagrams illustrating operating principles of the safety switch as shown in and described with reference to FIGS. 5 and 6.
Figure 8:
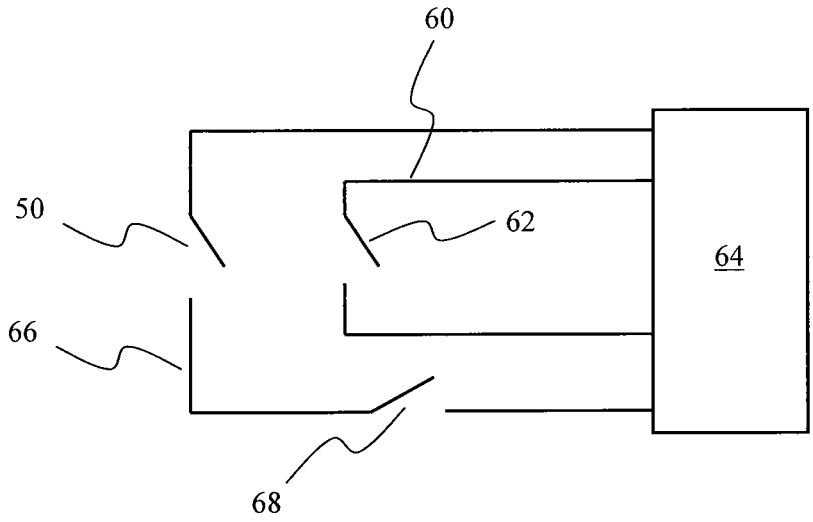

FIGS. 7 and 8 show simplified schematic representations of safety switches having a magnetically responsive operation according to the present invention. The magnetically operable switch 50 may be in connection with or form part of circuitry that is in connection with, or forms a part of, the fixed safety contacts 2, which are also located in the body 1.

Referring to FIG. 7, a first circuit 60 comprises a switch 62, which may be formed from the fixed and bridge contacts discussed previously. This first circuit 60 is in connection with a controller 64, which may not form part of the safety switch. A second circuit 66 includes the magnetically operable switch 50. The magnetically operable switch 50 may be configured to be in a normally open state (e.g. open unless the magnetisable material is magnetised), as is the switch 62 formed from the bridge and fixed contacts. Only when both switches 50, 62, are closed will the controller 64 allow the machinery to which the safety switch is connected to conduct electricity, or the like. In other words, the controller 64 will only allow electricity to be supplied to the machinery if two checks are undertaken and passed: that the contact block plunger has been moved into a position which results in the bridging of the fixed contacts, and also that the presence of the engagement of the actuator has been detected. These two checks are undertaken with only a single safety switch, and there is therefore no need for a second safety switch as is often the case in the prior art.

FIG. 8 shows a related but alternative circuit diagram. In this alternative, one or more bridge and fixed contacts may form another switch 68 which may be located in series with the magnetically operable switch 50. Such an arrangement may be preferred, since now two switches comprising the bridge and the fixed contacts in the body of the safety switch need to be closed, together with the detection of the actuator, before the controller 64 allows electricity to be supplied to the machinery. This may improve the redundancy of the safety switch, and/or its safety functionality.

It will be appreciated that the embodiments described above in relation to the Figures have been given by way of example only. Various modifications may be made to those embodiments. For instance, in the embodiments described above, the magnetisable material has a rod-like shape. Other shapes are possible, for example a magnetisable material which takes the shape of an internal or external surface of the body of the safety switch, the head of the safety switch, or which forms part of the body or head of the safety switch. The magnetisable material need only, in functional terms, extend (in any way) from a part of the safety switch proximate to a location of engagement of the actuator (provided with or comprising a magnet), to a region proximate to the magnetically operated switch. In one embodiment, the magnetisable material may only extend from outside of the body, and into the body. In another embodiment, the magnetisable material may alternatively or additionally extend from the head of the safety switch and into the body. The magnetically operable switch may be, or comprise, a reed switch, or any other convenient switch that may be operated using a magnetic field and is capable of conducting electricity in one or more states of operation (e.g. in a closed state). In FIGS. 5 and 6, the actuator is shown as comprising a magnet which is attached to the actuator. In another embodiment, a section of the actuator may comprise a magnet, or the actuator as a whole could be a magnet.

The term 'proximate' or the like, as used herein to describe the location of a magnet or of a magnetisable material, may be defined functionally. For example, the term 'proximate' or the like, as used herein to describe the location of a magnet or of a magnetisable material, may equate to a distance sufficient for the magnet to be able to magnetise the magnetisable material and, in turn, for the magnetised magnetisable material to affect the operating state of the magnetically operated switch.

The safety switch described above formed an embodiment of the present invention may be manufactured and sold as a new switch, or an existing switch may, be retrofitted with the additional features associated with the magnetically responsive switch operation as described above.

In the embodiments described above, a plurality of safety contacts has been described. However, it will be appreciated that any suitable configuration of safety contacts (and even auxiliary contacts) may be employed. For example, a contact block plunger may be provided with only a single safety bridge contact, and not two as shown in the Figures.

In some embodiments (e.g. those shown in the Figures) a plunger provided with contacts extending through the plunger may be located in a contact block or the like. The plunger in the contact block may be biased against a surface of the cam arrangement. Alternatively, the plunger in the contact block may be biased against an intermediate plunger (referred to as a switch plunger, to distinguish from the contact block plunger) located substantially outside of the contact block. The switch plunger may be biased against the cam arrangement by the contact block plunger.

It will be understood by the skilled person that a contact is a conductor which may be shaped at each of its ends, i.e. to define contact points. In the above described embodiments, the moveable safety and auxiliary contacts are conductors which extend transversely through the plunger, and protrude from both sides of the plunger (i.e. they are bridging contacts). The fixed contacts are conductors fixed in position relative to the body of the safety switch (which body may be, comprise, or form part of the body or head of the safety switch).

The plunger of the present invention has been described in relation to a safety switch having a fixed set of contacts located and fixed in position in the body of the safety switch. The fixed contacts form a contact block. The safety switch contact block is a structure that is provided with the fixed contacts (or conductors). The safety switch contact block as a whole is fixed in position into the body. The fixed contacts may thus be formed integrally with the body, individually fixed in position in the body, or form part of a contact block which is itself fixed in position in the body. The contact block may be removable and/or replaceable.

In the foregoing description, the safety switch has been described as having a cam arrangement and plunger co-operable with the cam arrangement. However, other control mechanisms may be used to control movement of the contact block plunger upon engagement or withdrawal of an actuator. For example, rather than being rotary in terms of motion, another (different) control mechanism might comprise a slideable or pivotable element or the like for control movement of the contact block plunger.

In the foregoing description, the making or breaking, or opening or closing, of contacts has been described as having the effect of allowing or preventing the safety switch from conducting electricity to electrically powered machinery to which the safety switch is connected. However, opening or closing of the contacts may have the more general effect of changing the operating state of the machinery, for example to a safe state, or slowing the machinery down, or stopping its movement while still maintaining its power supply. The changing of the operating state may be controlled directly by the safety switch (e.g. power supplied or not supplied) or by a controller in connection with the safety switch and the machinery. The opening or closing of contacts in the safety switch may be used by the controller to determine the control that is required to alter the operating state of the machinery.

It will be appreciated by a person skilled in the art that the invention is not limited to the embodiments described above, and that various modifications may be made to those embodiments, and other embodiments not described herein, without departing from the invention, which is defined by the claims which follow.

The invention claimed is:

1. A safety switch, comprising:

a body, comprising:

a contact block provided with at least two fixed contacts;

a contact block plunger provided with a bridge contact, the contact block plunger being moveable to move the bridge contact into and out of electrical connection with the two fixed contacts; and a biasing element, arranged to bias the contact block plunger towards a control mechanism of the safety switch;

a head containing at least a part of the control mechanism, engageable with an actuator that removably cooperates with the head and that is moveable to control movement of the contact block plunger upon engagement or withdrawal of the actuator, the control mechanism being moveable from a first configuration, where the actuator is withdrawn and the contact block plunger is in a position that keeps the fixed contacts and bridge contacts out of electrical connection with one another, to a second configuration, where the actuator is engaged and the contact block plunger is in a position that brings the bridge contact into electrical connection with, and bridges, the two fixed contacts;

a magnetically operable switch located in the body; and a magnetisable material that is positionally fixed and extends from proximate to a. location of engagement of the actuator to a region proximate to the magnetically operated switch such that when an actuator comprising a magnet is engaged with at least a part of the control mechanism of the safety switch, the magnet is proximate the magnetisable material such that the magnetisable material is magnetised thus affecting an operating state of the magnetically operable switch.

2. The safety switch of claim 1, wherein the magnetisab e material extends from outside of the body, and into the body.

3. The safety switch of claim 1, wherein the magnetisable material extends from the head and into the body.

4. The safety switch of claim 1, wherein the magnetisable material extends from a location adjacent to or at an external surface of the head, and into the body.

5. The safety switch of claim 1, wherein the magnetisable material has a substantially rod-like shape.

6. The safety switch of claim 1, wherein the body is one of sealable or is sealed.

7. The safety switch of claim 6, wherein the body is one of sealable or is sealed to prevent at least one of water or dirt from entering into the body.

8. The safety switch of claim 1, wherein the head is one of unsealable, or is unsealed.

9. The safety switch of claim 8, wherein the head is unsealable, or is unsealed, such that at least one of water or dirt is allowed to come into contact with the at least a part of the control mechanism that is engageable with said actuator.

10. The safety switch of claim 1, wherein the magnetically operable switch is in an open state, unless the magnetisable material is magnetised.

11. The safety switch of claim 1, wherein the magnetically operable switch comprises a reed switch.

12. The safety switch of claim 1, wherein the control mechanism comprises a rotatable cam arrangement that is the part of the control mechanism located in the head.

13. The safety switch of claim 12, wherein the control mechanism comprises a switch plunger that is at least one of located between the cam arrangement and the contact block plunger, and extends between the head and the body.

* * * * *

UNITED STATES PATENT AND TRADEMARK OFFICE

CERTIFICATE OF CORRECTION

PATENT NO. : 8,653,914 B2
APPLICATION NO. : 13/113221
DATED : February 18, 2014
INVENTOR(S) : Jones et al.

It is certified that error appears in the above-identified patent and that said Letters Patent is hereby corrected as shown below:

IN THE CLAIMS

| | |
|---|---|
| CLAIM 1, Line 26<br>Col. 10, Line 23 | DELETE "a. location" and substitute therefore<br>-- a location -- |
| CLAIM 2, Line 1<br>Col. 10, Line 31 | DELETE "magnetisab e" and substitute therefore<br>-- magnetisable -- |

Signed and Sealed this
Thirteenth Day of May, 2014

Michelle K. Lee

Michelle K. Lee
*Deputy Director of the United States Patent and Trademark Office*